US011305155B2

(12) United States Patent
Petersen

(10) Patent No.: US 11,305,155 B2
(45) Date of Patent: Apr. 19, 2022

(54) APPARATUS AND METHOD FOR PHYSICAL EXERCISES

(71) Applicant: SURCLES LLC, Running Springs, CA (US)

(72) Inventor: Erik Flann Petersen, Running Springs, CA (US)

(73) Assignee: SURCLES LLC, Running Springs, CA (US)

( * ) Notice: Subject to any disclaimer, the term of this patent is extended or adjusted under 35 U.S.C. 154(b) by 18 days.

(21) Appl. No.: 16/933,447

(22) Filed: Jul. 20, 2020

(65) Prior Publication Data

US 2020/0346070 A1 Nov. 5, 2020

Related U.S. Application Data

(63) Continuation of application No. PCT/US2019/014503, filed on Jan. 22, 2019.
(Continued)

(51) Int. Cl.
*A63B 22/16* (2006.01)
*A63B 21/00* (2006.01)
(Continued)

(52) U.S. Cl.
CPC ..... *A63B 22/16* (2013.01); *A63B 21/4033* (2015.10); *A63B 21/4049* (2015.10);
(Continued)

(58) Field of Classification Search
CPC . A63B 22/16; A63B 21/4033; A63B 21/4049; A63B 69/0048; A63B 69/0093; A63B 2022/0092; A63B 2208/0204; A63B 2208/0223; A63B 2209/02; A63B 2210/50; A63B 2225/09; A63B 19/02; A63B 26/003; A63B 22/00; A63B 2209/00; A61H 1/02; A61H 15/00; A61H 1/0292; A61H 2201/1619; A61H 2203/0443; A61H 2201/1623; A61H 2205/081; A61H 2205/083; A61H 2201/1261; A61H 2015/0014; A61H 2201/1628
See application file for complete search history.

(56) References Cited

U.S. PATENT DOCUMENTS 883,485 A * 3/1908 Ridgway ..... A63G 31/14 472/137
1,264,738 A * 4/1918 Woolard ..... A63G 7/00 104/53
(Continued)

OTHER PUBLICATIONS

International Search Report and Written Opinion issued for PCT/US2019/014503, dated Mar. 22, 2019, 10 pp.

*Primary Examiner* — Garrett K Atkinson
(74) *Attorney, Agent, or Firm* — Zeller IP Group, PLLC; Kyle M. Zeller

(57) ABSTRACT

An apparatus and a method for physical exercises is provided. The apparatus may include at least one rigid cylinder of circular or polygonal shape. The apparatus is designed for functional training exercises, including but not limited to, dry-land, surf-specific training. The apparatus is versatile and may be used in any and all fitness programs, as well as physical and rehabilitation therapy. Corresponding methods for performing physical exercises on at least one rigid cylinder are also provided.

14 Claims, 10 Drawing Sheets

Related U.S. Application Data

(60) Provisional application No. 62/620,421, filed on Jan. 22, 2018.

(51) Int. Cl.
*A63B 69/00* (2006.01)
*A63B 22/00* (2006.01)

(52) U.S. Cl.
CPC ..... *A63B 69/0048* (2013.01); *A63B 69/0093* (2013.01); *A63B 2022/0092* (2013.01); *A63B 2208/0204* (2013.01); *A63B 2208/0223* (2013.01); *A63B 2209/00* (2013.01); *A63B 2209/02* (2013.01); *A63B 2210/50* (2013.01); *A63B 2225/09* (2013.01)

(56) References Cited

U.S. PATENT DOCUMENTS 1,339,749 A * 5/1920 Floyd ..... B65D 9/12 217/44
1,459,991 A * 6/1923 Rooks ..... B65D 9/04 147/1
1,513,712 A * 10/1924 McClenny ..... B65D 9/04 147/1
1,521,133 A * 12/1924 Tinker ..... A47C 3/029 D21/424
1,648,786 A * 11/1927 Smoak ..... B65D 9/22 217/44
2,001,205 A * 5/1935 Marten ..... A63G 29/00 280/207
2,649,124 A * 8/1953 Merron ..... B27H 3/04 217/88
2,681,638 A * 6/1954 Carvell ..... A01K 15/027 119/700
3,464,718 A * 9/1969 Fisher ..... A63B 19/02 280/206
3,536,324 A * 10/1970 Ahrens ..... A63B 19/04 104/77
3,537,726 A * 11/1970 Conover ..... A63B 19/02 280/206
3,905,617 A * 9/1975 Smith ..... B62K 1/00 482/54
3,985,234 A * 10/1976 Jouffray ..... B66C 23/707 52/118
4,316,540 A * 2/1982 Lapham ..... B65D 21/04 206/518
4,389,047 A * 6/1983 Hall ..... A63B 21/0054 482/54
4,482,151 A * 11/1984 Zwilling ..... A63B 21/0728 482/106
4,716,271 A * 12/1987 Hulsizer ..... B23Q 9/0021 219/60 R
4,826,159 A * 5/1989 Hersey ..... A63B 26/003 482/146
5,004,203 A * 4/1991 Fabius ..... F16M 11/14 403/109.1
5,020,323 A * 6/1991 Hurlimann ..... F16M 11/28 414/718
5,087,033 A * 2/1992 Tagney ..... A63B 19/04 434/247
5,125,361 A * 6/1992 Rowlands ..... A01K 15/027 119/700
5,243,224 A * 9/1993 Tagney, Jr. ..... A63B 19/04 482/84
D340,498 S * 10/1993 Warren ..... D21/826
5,256,116 A * 10/1993 Robinson ..... A63B 69/0048 482/37
5,387,159 A * 2/1995 Hilgert ..... A63B 19/04 472/91
5,545,115 A * 8/1996 Corcoran ..... A63B 22/16 482/146
5,897,474 A 4/1999 Romero
6,074,305 A * 6/2000 Schnapp ..... A63G 29/00 280/206
6,168,551 B1 * 1/2001 McGuinness ..... A63B 69/0093 482/146
RE37,559 E * 2/2002 Marue ..... F16M 11/28 52/118
6,402,624 B1 * 6/2002 Larson ..... A63G 7/00 472/44
6,500,097 B1 * 12/2002 Hall ..... A63B 19/04 482/69
6,503,179 B2 * 1/2003 Miraflor ..... A63B 21/4045 482/141
D484,284 S * 12/2003 Venson ..... D30/160
6,740,009 B1 * 5/2004 Hall ..... A63B 19/04 482/69
7,288,849 B1 * 10/2007 Chiang ..... F03G 5/025 290/1 R
7,452,313 B2 * 11/2008 Endelman ..... A63B 21/4037 482/142
7,513,832 B2 * 4/2009 Gallagher ..... A63C 19/10 472/91
7,563,217 B2 * 7/2009 Endelman ..... A63B 21/00047 482/121
7,803,092 B2 * 9/2010 Gilliam ..... A63B 24/0003 482/148
8,052,586 B2 * 11/2011 Hahn ..... A63B 17/00 482/142
RE43,981 E * 2/2013 Endelman ..... A63B 21/00047 482/121
9,132,974 B2 * 9/2015 Savage ..... B65D 9/06
9,138,611 B2 * 9/2015 Towley, III ..... A63B 21/0726
9,789,387 B2 * 10/2017 Shea ..... A63B 67/02
10,182,555 B2 * 1/2019 Farley ..... A01K 29/00
D884,984 S * 5/2020 Bernardini ..... D30/119
10,828,523 B2 * 11/2020 Briggs ..... A63B 5/16
2002/0050112 A1 * 5/2002 Koch ..... F16C 33/3856 52/651.07
2002/0128130 A1 * 9/2002 Miraflor ..... A63B 23/1245 482/141
2003/0050153 A1 * 3/2003 Stevens ..... A63B 21/0603 482/92
2005/0187075 A1 8/2005 Bellamy
2006/0093435 A1 5/2006 Unterweger
2006/0134583 A1 * 6/2006 Gonzalez de Mendoza y Kaeding ..... A63B 69/0028 473/247
2006/0217250 A1 9/2006 Pearson
2008/0167168 A1 * 7/2008 Hurst ..... A63B 22/20 482/132
2009/0312159 A1 * 12/2009 Gilliam ..... A63B 21/0601 482/93
2010/0179038 A1 * 7/2010 Hahn ..... A63B 17/00 482/142
2011/0124468 A1 * 5/2011 Incerti Fornaciari .. A63B 19/04 482/8
2013/0023388 A1 * 1/2013 English ..... A63B 23/047 482/93
2013/0093139 A1 * 4/2013 Shea ..... A63B 67/066 273/354
2013/0094934 A1 * 4/2013 Savage ..... B65D 9/06 217/72
2014/0274597 A1 * 9/2014 Towley, III ..... A63B 21/075 482/108
2015/0005140 A1 1/2015 Adkins et al.
2015/0246280 A1 * 9/2015 Shea ..... A63B 63/08 273/350
2018/0050261 A1 * 2/2018 Shea ..... A63B 67/02
2018/0110236 A1 * 4/2018 Donoughe ..... A23L 2/00
2020/0146221 A1 * 5/2020 Vienne ..... A47G 7/041

* cited by examiner

APPARATUS AND METHOD FOR PHYSICAL EXERCISES

CROSS-REFERENCE TO RELATED APPLICATIONS

The present application is a continuation of Int. Patent App. PCT/US2019/014503, filed Jan. 22, 2019, which claims the benefit of U.S. Provisional Patent App. 62/620,421, filed Jan. 22, 2018. Each of the above applications is incorporated by reference herein in its entirety.

BACKGROUND

This specification relates to dry land, surf-specific training apparatuses and methods.

Conventional dry land surf technologies involve the use of a flat board or a surfboard. While those attempts to model surfing on dry land have primarily focused on balance, the most closely related technology aiming at mimicking the surf sport is found in balance trainers, such as the NOHO surf trainer, which uses a real surfboard suspended several inches above the ground. With this system, it is possible to practice the take-off motion, which involves the grabbing rails (edges) of the surfboard in the prone position, pushing-off with the arms and jumping from the prone position to a standing position. As the board is positioned on small objects ("wobble devices") providing the desired unstable suspension, its range of motion is restricted and the simulation of the real movement of a surfboard during surfing on the ocean is very limited.

SUMMARY

The present invention has been conceived based on the realization that natural topographic features are comprised of polygonal, round or oval shapes, the latter including elliptical shapes in the context of this description. In fact, both ocean waves and mountain rocks may be represented as composites of round and polygonal shapes. In particular, the performance of surfers may be improved, therefore, through practiced movement on accordingly shaped training devices, which mimic natural features and, in addition, are not static but dynamic. The present application thus relates to a system of training devices for performing physical exercises, in particular for high-performance, surf-specific training, and to a corresponding methods of performing physical exercises.

Even though the fitness industry offers a large variety of physical exercise devices, the use of relatively large cylinders for health and fitness purposes has been so far restricted to foam rollers, which are known to have diameters on the order of 15 cm. So far, it is unknown to place the human body on rather large, rigid moving shapes. The apparatus for performing physical exercised disclosed herein teaches controlled movement and may be also used to provide systemic myofascial release. The achieved positive effect is lasting (months after training) and profound in that exercises involving the present exercise apparatus may improve strength, balance, coordination, flexibility, posture, digestion, circulation etc.

In various embodiments an apparatus and methods for physical exercises are provided. The apparatus includes at least one rigid, preferably freestanding, cylinder, wherein the cross section of the cylinder may be of polygonal, round or oval shape. The apparatus may be used for dry land surf-specific training, general fitness and physical therapy.

Overlooking those various fields of endeavor which may benefit from the apparatus for physical exercises as described herein, its general purpose may be training of coordinated balances.

The apparatus described herein, being a cylindrical exercise device, may be referred to as a SURCLE, which is an abbreviated form of Surf, Climb and Explore. In other words, one cylinder as an apparatus for physical exercises will be referred to as a SURCLE. A set of at least two or more such cylinders will be referred to as SURCLES. Use of one or more SURCLES during exercise or physical therapy will be referred to as SURCLING, SURCLE training, and SURCLE therapy, etc. Collectively, the devices and exercises described herein may be described as the SURCLE training system.

A polygonal embodiment of the cylindrical apparatus described herein, may include any and all polygons of five or more sides, whereby the sides may have any length from 1 centimeter to 1 meter.

According to an embodiment an apparatus for physical exercises may comprise a freestanding cylinder, wherein the cross section of the cylinder may be a polygonal, circular or oval. A SURCLE with a circular cross section may be seen to correspond to a limit case of a polygonal SURCLE, with segments forming a shape of the cross section being shortened to almost zero. The apparatus of the present invention may include one or more cylinders, defined by width (distance along the y-axis from one open end of the hollow cylinder to the opposite open end), diameter (the distance along the z-axis across the lumen of the cylinder, which may be about 75 cm or more, for example). Depending on the shape of the cross section, a SURCLE may be defined by radius, semi-minor and semi-major axes, side-number (number of sides defining the polygon, which may be 8 for example, i.e. an octagon) and side-length (length of the sides defining the polygon, which may be 7 cm, for example). The relative stability of each individual device may be adjusted by varying at least one of these parameters.

The interaction of an athlete with the outer surface of the apparatus of the present invention dictates success during the sports of surfing and climbing. In surfing these interactions occur very quickly and to some extent reactively, while climbers tend to move more deliberately, precisely placing hands and feet so as to maintain balance and purchase on rock surfaces. SURCLES represent a training system, which models the movements of both surfers and climbers on natural, 3-D polygonal, circular or oval features (e.g., FIGS. 5-9).

According to a further embodiment of the apparatus for physical exercises the cylinder(s) may be hollow.

The apparatus for physical exercises itself or a supporting structure is constructed to be rigid, such that shape of the SURCLE is substantially sustained under pressure, in particular under weight pressure of a person performing exercises on said device.

According to a further embodiment of the apparatus for physical exercises the cylinder(s) may have a diameter in the range between approximately 30 cm and approximately 1.5 meters, including any values in between such as 60 cm, 70 cm, 100 cm or 120 cm. According to further embodiments, the cylinder(s) may have a diameter of at least 35 cm, of at least 40 cm, of at least 45 cm or of at least 50 cm. A diameter of the SURCLE of 30 cm or more may be seen to be advantageous for various reasons. First, it matches the average length of the human thoracic spine, thus providing the critical support required for therapeutic correction of problems associated with the upper back. Second, it provides enough lift off the ground to simulate climbing on natural rock features, for example during exercises such as the one depicted in FIG. 9B. Third, it facilitates a take-off maneuver, the signature exercise for surf training (see, e.g., FIGS. 6A-C).

Independent of the geometrical form of the cross-section of the cylinder, the wall thickness of the cylinder of the present apparatus may be equal to approximately 8 cm or smaller. For example, the wall thickness of the cylinder(s) may be approximately 7.5 cm or smaller, approximately 5 cm or smaller, or approximately 3 cm or smaller. The lower limit for the thickness of the wall of the cylinder(s) may be basically set by the boundary condition that the SURCLE is a substantially rigid object which does not deform under weight pressure of a person performing exercises thereon. A wall thickness in any of the specified ranges provides for a good grasp of the SURCLE during its use. In addition, it facilitates placement of SURCLES into one another to form a nested configuration.

According to a further embodiment, the polygonal cylinder may have a non-uniform diameter in the range between approximately 30 cm and approximately 2 m. For instance the cylinder may have a greater diameter at a midpoint between the two rails (edges) of the device, and thus resembling a barrel—a feature that would greatly increase the level of difficulty in performing exercises such as the take-off.

In one embodiment, the side segments of the polygonal cylinder may have the same length. In another embodiment, the side segments of the polygonal cylinder may have different lengths. In yet another embodiment, According to a further embodiment of the apparatus for physical exercises, the distance between the two rails (open ends) of the cylinder (e.g., FIG. 1 at 110), i.e. the width of the SURCLE, may lie in the range between approximately 20 cm and approximately 2 m, including any values in between, such as 25 cm, 40 cm, 50 cm, 75 cm or 1.5 meters.

According to further embodiments, the apparatus may include at least one further cylinder having the same cross sectional shape but a different diameter, with the smaller one of the at least two cylinders being arranged inside the larger one of the at least two cylinders. Such a nested configuration may be used for exercises and/or for space-saving storage of the SURCLES. However, all SURCLES used in a nested configuration are rigid, preferably hollow and relatively large with respect to currently available hollow rollers. Different nested configurations may be formed by nesting a any number of cylinders. SURCLES from nests of different shapes may be mixed and matched during training and therapy. Based on empirical observation it has been found that that using SURCLES for any exercise or posture is affected by the number of additional SURCLES inside the largest SURCLE upon which the user is balanced. By varying the configuration of the nested arrangement the weight and the center of gravity of the apparatus may be varied/adjusted, which increases or decreases the difficulty of an exercise.

Overall, the rigid cylinders of various shapes used herein are of a size which is so far not known to be used for physical fitness and physiotherapy. In certain exercises, the rigid nature of the cylinders serves to elongate the body in a manner not achieved by small rollers or by large compressible exercise balls. This difference to known devices provides a substantial benefit to users. For example, hanging backwards ("Giant Layback") on a large SURCLE has tremendous physiologic benefit and is a form of self-physiotherapy.

In contrast, compressible exercise balls do not force the body into a different posture in the same manner as the present apparatus. In addition, providing the cylinders in sets of various sizes enables every person, independent of their height, to enjoy the same beneficial effects by selecting the right sized SURCLE(S).

According to various embodiments, the apparatus may include a free-standing exercise device that is hollow and seamless. Such device be extruded, molded or otherwise formed from various materials, including, for example: plastic, aluminum, stainless steel, carbon fiber, fiberglass, and others.

In other embodiments, the apparatus may include one or more seams. Such embodiments may be formed through the rolling of sheets of various materials into polygonal cylinders and welding them. Exemplary materials may include aluminum, stainless steel, and others.

According to a further embodiment of the apparatus for physical exercises, the cylinder may include several rectangular sections, which are arranged adjacent to one another to form an outer surface. In some cases, the shorter sides of the rectangular sections may form the polygonal shape of the cross section of the cylinder. In other words, the side surface of the cylinder may be formed by several rectangular sections such as boards, plates or panels aligned side by side, with their longer side lying parallel to one another, extending from one end of the cylinder to the other opposing end of the cylinder. It is noted that the term "shorter side" (or short side) of the rectangular section may refer to an actual surface, which is arranged at the rails or edges of a corresponding SURCLE. In general, a SURCLE may include rectangular sections or rectangular portions with a side-length (i.e. a length of the shorter side) of at least 1 cm, for example 2 cm, 3 cm, or 5 cm The rectangular sections may form a rigid polygonal backbone of the SURCLE and maybe be made from various materials such as wood, bamboo, aluminum, aluminum alloys, PVC, carbon fiber or stainless steel. Such materials may be also used to manufacture round and oval cylinders.

According to a further embodiment of the apparatus for physical exercise the shorter sides of the rectangular sections of a polygonal SURCLE may have different lengths, wherein shorter sides with shorter lengths and shorter sides with longer lengths are arranged in an alternating manner to form the polygonal shape of the cross section. In general, adjusting the length of the shorter sides of the rectangular section may be used to model the dynamics of the apparatus during its use.

According to a further embodiment the apparatus for physical exercises may include a supporting structure, which is provided within the cylinder. In such embodiments, in the rectangular sections may be attached to the supporting structure.

According to a further embodiment of the apparatus for physical exercises the supporting structure may include at least two rings that are provided concentrically within the barrel, at a distance from one another. In such embodiments, the rectangular sections may be attached to the at least two rings.

In one specific embodiment, the polygonal cylinder may include rectangular elements, each having a length of 46 cm. It will be appreciated that, in such cases, width of the cylinder will also be 46 cm.

According to a further embodiment the apparatus for physical exercises may include comprise a cladding material provided on the outer surface of the cylinder. The cladding material may be compressible under pressure, for example, under weight pressure of a person performing exercises on the SURCLE. The cladding material may cover various portions of the outer surface of the SURCLE and, in general, may be used to adjust the friction coefficient of the outer surface thereof. The cladding material may be made from, for example, a soft foam, neoprene, rubber and/or other materials.

According to various embodiments, the apparatus described herein may be a set of cylindrical training devices—the SURCLES. Two SURCLES may be used for simulating a take-off in the sport of surfing, which involves standing-up on the feet, while pushing-off with the hands.

SURCLES may be targeted to different phases of training by changing their diameter. For example it is more difficult to take-off on a SURCLE possessing a relatively small diameter (e.g. 35 cm), as compared to taking-off on a SURCLE with a larger diameter (e.g. 55 cm).

The SURCLE may be used in order to simulate various postures and movements in the sport of surfing, e.g. standing in an upright position on a surfboard during surfing, or for functional training, general fitness training and physical therapy.

SURCLES may be targeted to different phases of training by changing their geometrical shape, whereby it is more difficult, due to a greater angle of wobble, to take-off on a SURCLE of 5 sides (pentagon), as compared with taking-off on a SURCLE composed of an 8-sided (octagon) polygon. The use of round SURCLES will be most challenging.

SURCLES may be targeted to different phases of training by changing their relative position during exercise. For example, it is more difficult due to inversion, to take-off on a SURCLE of 55 cm diameter when pushing-off of a 35 cm diameter SURCLE, as compared with taking-off on 35 cm diameter SURCLE when pushing-off a SURCLE having a 55 cm diameter.

From the point of view of dry-land surf specific training, each individual SURCLE in a set of SURCLES may be seen to mimic in both size and shape natural ocean waves which to a first approximation have a round or polygonal shape, as shown in the left image of FIG. 11A. Movements performed on a single SURCLE or, for example, on two SURCLES, simulate movements performed during bodysurfing and board surfing, wherein bodysurfing refers to the sport of riding a wave without using any buoyant devices such as surfboards. In particular, two SURCLES may be used simultaneously to simulate the surf take-off, which is the most fundamental and important step in surfing. SURCLE training involves moving on 3D polygonal shapes which model ocean waves rather than on 2D boards, such as balance boards or surfboards, thus training the body more efficiently to move in a surf-specific manner.

Training with SURCLES stimulates spatial awareness and adaptation to rapid changes in elevation and is thereby not only conducive to the sport of surfing but it may be also used as effective training for any kind of dynamic adventure sports. SURCLES are suitable for use in all settings, including home, fitness outlets, grass, poolside, beachside, physiotherapy offices etc. as no specific subsurface is required. A set of SURCLES may be stored in a space saving manner by placing every smaller SURCLE concentrically within a next bigger SURCLE to obtain the already described nested configuration. Altogether, a set of SURCLES may provide an incremental, controlled system for body de-stabilization, and therefore represents a novel training device for physical therapy, rehabilitation, adventure training and extreme sports conditioning.

The apparatus of the present invention may be a one or more rigid cylinders, wherein each cylinder is defined by a width (distance between the rails), height (outer diameter of the cylinder), and cross section. The relative stability of each individual device may be adjusted by varying at least one of these parameters. A polygonal cross section may include at least five sides and connected to one another at certain angles (see FIGS. 1-4). The interaction of an athlete with these sides and angles or with a round or oval surface dictates success during the sports of surfing and climbing. In surfing these interactions occur very quickly and to some extent reactively, while climbers tend to move more deliberately, precisely placing hands and feet so as to maintain balance and purchase on rock surfaces. SURCLES represent a training system which models the movements of both surfers and climbers on polygonal surfaces (see FIGS. 5-9).

According to a further embodiment of the apparatus for physical exercises the cylinder(s) may be hollow. In an alternative embodiment, the cylinder may be filled with a material, for example a foamy or flexible material defining the compressibility of the barrel under pressure, for example under weight pressure of a person standing on the cylinder.

According to a further embodiment of the apparatus for physical exercises the shorter sides of the rectangular sections may have the same length.

According to a further embodiment, the apparatus for physical exercises may further include a supporting structure which is provided within the barrel, wherein the rectangular sections are attached to the supporting structure.

According to a further embodiment of the apparatus for physical exercises, the supporting structure may include at least two rings, which are provided concentrically within the cylinder at a distance from one another. In such embodiments, the rectangular sections may be attached to the at least two rings.

According to a further embodiment of the apparatus for physical exercises, the polygonal shape of the cross section may have at least five sides.

According to a further embodiment of the apparatus for physical exercises, the cladding material provided on the outer surface of the SURCLE may be located only on end portions thereof such that a middle portion of the outer surface of the SURCLE is not covered by the cladding. In other words, the cladding material may be provided on the outer surface of the SURCLE in stripes, the stripes covering only annular sections of the outer surface of the SURCLE, wherein each stripe is arranged proximal to the top edge and bottom edge of the outer surface of the SURCLE, respectively.

According to a further embodiment of the apparatus for physical exercises, the cylinder may have a diameter in the range between approximately 50 cm and approximately 2 m.

According to a further embodiment of the apparatus for physical exercises, the distance between the two ends of the SURCLE (i.e. the width of the cylinder) may lie in the range between approximately 20 cm and approximately 2 m. In a preferable embodiment, a polygonal SURCLE may be composed of rectangular elements, each having a length of 46 cm (which is then also the width of the barrel).

According to further embodiments, the apparatus for physical exercises may include at least one further cylinder having the same cross sectional shape but a different diameter, with the smaller one of the at least two cylinders being arranged inside the larger one of the at least two cylinders. In particular, a multitude of cylinders may be used which provide a nested set of cylinders.

According to a method for performing physical exercises on the apparatus for physical exercises, the method may include exercises targeting many different disciplines of the health and fitness industry, including yoga, climbing, fitness centers, functional training facilities, professional sports clubs, schools, universities etc.

One or more SURCLES may be also used for basic exercise and for modern sport-specific functional training. Training based on SURCLES relies on coordinated, whole body movements, rather than balance alone. Multiple users can work out on a set of SURCLES simultaneously. Training with SURCLES stimulates spatial awareness and adaptation to rapid changes in elevation and is thereby not only conducive to the sport of surfing but it may be also used as effective training for any kind of dynamic adventure sports. SURCLES are suitable for use in all settings, including home, fitness outlets, grass, poolside, beachside, physiotherapy clinics, corporate offices etc. as no specific subsurface is required. A set of SURCLES may be stored in a space-saving, nested, manner by placing every smaller SURCLE concentrically within a next bigger SURCLE. Altogether, a set of SURCLES may provide an incremental, controlled system for body de-stabilization, and therefore represents a novel training device for physical therapy, rehabilitation, adventure training and extreme sports conditioning.

According to a method for performing physical exercises on the apparatus for physical exercises, the method may include balancing on said cylinder. In another embodiment, the method may include balancing on said cylinder while standing or squatting thereon. In yet another embodiment, the method may include land-based surfing or bodysurfing exercises. In other embodiments, the SURCLES may be employed for core exercises, yoga, strength exercises, and climbing exercises (e.g., in various positions ranging from standing to sitting).

According to a further embodiment, the method for performing physical exercises on said apparatus may include using a second cylinder positioned at a distance from a first cylinder with their symmetry axes being parallel to one another; starting the exercise in an extended horizontal position of the body placed upon both cylinders; and pushing off of one of the cylinders to come to a stand on one of the cylinders (see FIG. 6).

In some cases, the two cylinders may have different diameters. Alternatively, the two devices may have equal diameters.

According to a further embodiment, the method for performing physical exercises may include providing at least one further cylinder of the same cross sectional shape, but of different diameter, arranging the smaller one of the at least two cylinders inside the larger one of the at least two cylinders to perform the exercise to obtain a nested configuration of cylinders, and performing the exercise on the nested configuration of cylinders.

According to further embodiments, a use of at least one rigid cylinder to perform physical exercises is disclosed herein. In the disclosed use, the freestanding cylinder(s) may be the apparatus disclosed herein, in all its aspects, and the disclosed use may be performed according to the various methods disclosed herein. In particular, the use may include the use of a nested configuration of a multitude of cylinders, with each smaller cylinder being arranged inside of a larger cylinder, for the various purposes disclosed herein.

According to a further embodiment of the method for performing physical exercises on said apparatus the physical exercises may include physical therapy exercises (see FIGS. 10A-B). The SURCLES may be offered to users as a set of therapeutic devices, e.g. as a set including two or more cylinders of increasing diameter, whereby the therapeutic benefit derives from the fact that SURCLES are stable along both the y-axis and z-axis, thus limiting movement to the semi-stable x-axis (see FIG. 1). Instability in all directions, as in the case of other fitness equipment such as balance balls, may be too challenging for physical therapy. Here, SURCLES may be more suitable as they may provide instability only along one axis, i.e. the x-axis along which the training cylinder may roll.

Furthermore, a set of SURCLES may contain multiple devices, each with a different diameter, such as a set of cylinders with diameters of 45 cm, 55 cm, 65 cm and 75 cm, thus providing a wide dynamic range of body movements and positions on said devices. As an example, a Giant Layback maneuver (see FIG. 10A) may be performed, wherein three different devices are used to support the hands, feet and torso, respectively. The diameter of the SURCLE used to support the torso dictates the angle of stretch.

As another example, the devices may be employed for postural therapy (see FIG. 10B).

BRIEF DESCRIPTION OF THE DRAWINGS

Various features, aspects and embodiments of the apparatus as well as the method for physical exercises are described with reference to the accompanying drawings.

DETAILED DESCRIPTION

The present invention is based on the fact that ocean waves or any other form of artificially provided waves that may be used for surfing are round or oval in shape (once again, including elliptical shapes). To a first approximation, however, they may be seen to be polygonal in shape. They have both smooth curves and angular sections and occasionally form complete cylinders, which are also referred to as tubes, tube riding being considered the ultimate maneuver in surfing. Retaining an upright position during surfing on a surfboard which is rolling, pitching and yawing in accordance with the (approximately polygonal) 3D contours of a waveform is very challenging.

The realization leading to the present invention is that dry land training on 3D models of real ocean waves enables more efficient and effective surf-specific training in comparison to other surf training techniques based on balancing on a 2D surfboard.

In the following description, the apparatus for physical exercises according to the invention will be referred to as SURCLE. Application of a SURCLE or a set of SURCLES for any purpose will be referred to as SURCLING.

Figure 1:
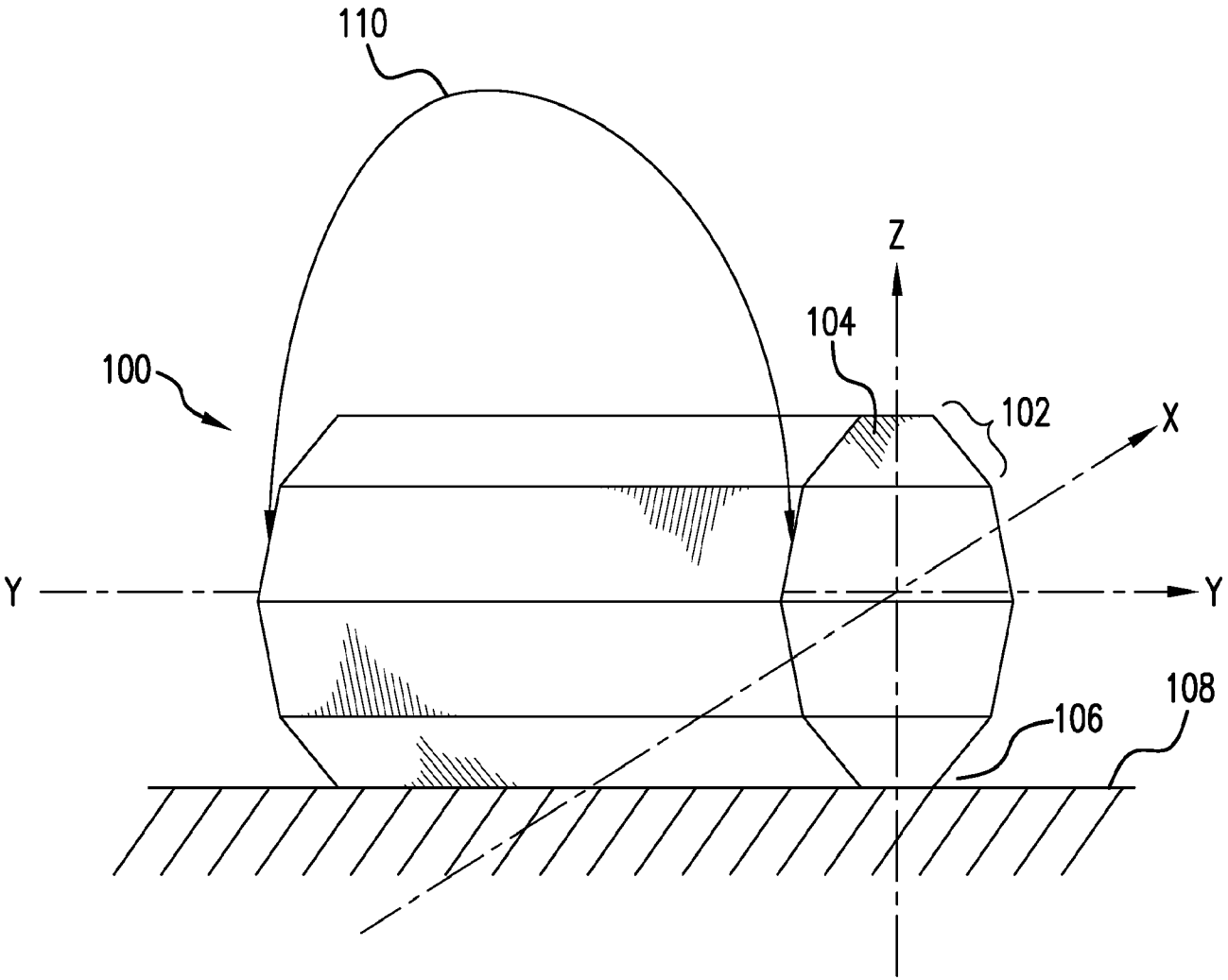
FIG. 1 shows a schematic lateral view of an embodiment of the apparatus for physical exercises (the SURCLE).

FIG. 1 shows a schematic lateral view of a polygonal embodiment of the apparatus for physical exercises 100, i.e. the SURCLE. During various exercises, the SURCLE 100 in the form of a freestanding cylinder may rest on a supporting floor 108 which may be any kind of floor such as gymnasium, yoga studio, physical therapy clinic, corporate office, pool deck, lawn, beach sand, community center or house floor. In this exemplary embodiment shown in FIG. 1, the SURCLE 100 is of decagonal shape, i.e. its defining polygonal shape is decagonal. The decagonal shape of the hollow cylinder which defines SURCLE 100 is only one of very many possible shapes as will be discussed further below. Independent of the actual geometry of the polygonal cylinder which defines SURCLE 100, the cylinder is rigid and symmetric across its width along the y-axis, and its diameter along the z-axis. In the exemplary embodiment shown in FIG. 1, both ends of the polygonal cylinder which define SURCLE 100 include ten base sides 102, which are arranged at angles 104 adjacent to one another, which in the case of this symmetric decagon measure 144 degrees. The angle 104, which is created during fabrication of the SURCLE 100 from a rigid substrate, such as aluminum or carbon fiber, imparts a corresponding angle 106 between the SURCLE 100 and the flooring 108. The angle 106 creates a wobble as the SURCLE 100 moves along the x-axis, simulating the movement a surfer might experience while taking-off on a polygonal shaped ocean wave FIG. 10. In this exemplary embodiment of the SURCLE 100, all base sides 102 have the same length. However, other embodiments may have base sides 102 of different lengths, which may, for example, be arranged in an alternating manner to achieve various wobble effects with regard to the stability of the SURCLE 100. The top and bottom edges of the polygonal cylinder will be referred to as rails 110.

SURCLE 100 may be constructed of a rigid substrate, rendering it stable along both the y-axis and z-axis, and limiting movement to along the x-axis. For example, SURCLE 100 may be constructed of rigid aluminum and may be covered in soft sport foam (see SURCLE 400 in FIG. 4). The aluminum SURCLE may be rendered by extrusion of a solid 3D aluminum billet through a polygonal die. Alternatively, rolling an aluminum sheet into a polygonal cylinder may render SURCLE 100. In addition, SURCLE 100 may be constructed of any rigid substrate, for example, plastic, stainless steel, carbon fiber, PVC or fiberglass. The wall thickness of SURCLE 100 may include any thickness from 1 mm to 100 mm. SURCLES with round or oval cross sections may be manufactured accordingly. The stability along both the y-axis and z-axis renders the SURCLE uniquely effective in providing support for the body during therapeutic movements such as the Giant Layback (FIG. 10). The stability along both the y-axis and z-axis also makes the SURCLE ideal for therapeutic sitting, during which the SURCLE may be moved back and forth along the x-axis to enhance blood flow and a healthy posture during normal work at a desk for example.

Figure 2:
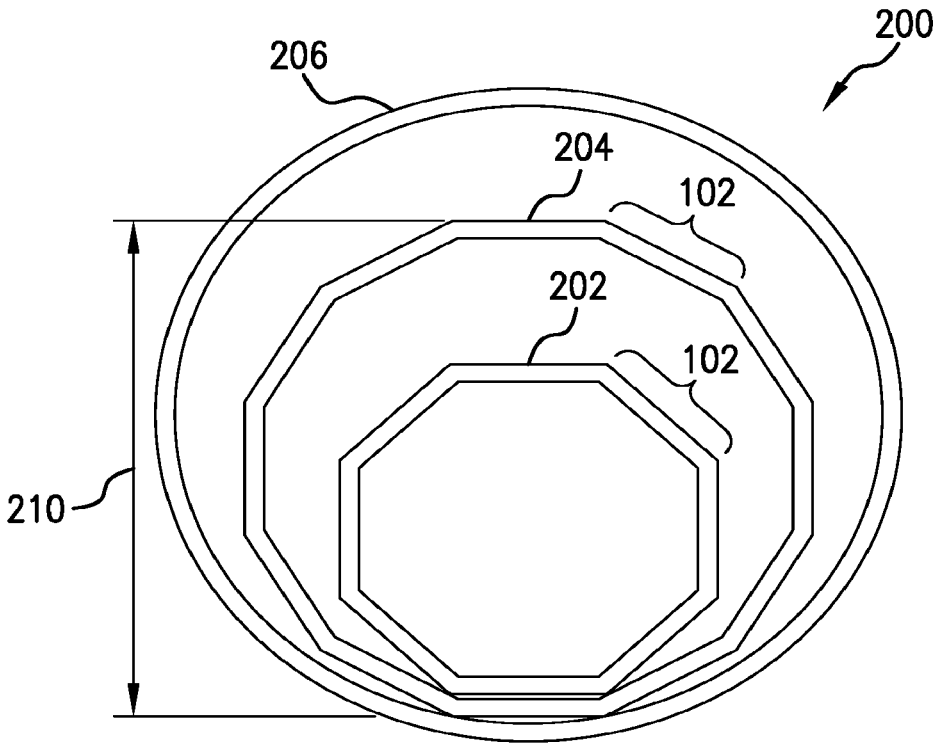
FIG. 2 shows a schematic overview of an exemplary set of apparatuses for physical exercises.

FIG. 2 shows an overview of an illustrative set of polygonal SURCLES 200. The set of SURCLES 200 is presented in a side view. The first SURCLE 202 is of octagonal shape, the angle between every two base sides 102 of the eight base sides 102 being equal to 130 degrees. The second SURCLE 204 is a polygon with twelve sides in total, the angle between every two base sides 102 being equal to 150 degrees. The third SURCLE 206 is a cylinder with a circular bottom and top area and may be seen as the limit case when the number of base sides 102 grows towards infinity and at the same time their length tends towards zero. In general, a set of SURCLES may contain different polygonal shapes, e.g. with different number of base sides 102 and/or different lengths of the base sides 102 forming different angles therebetween, and different diameters. Even though not explicitly shown, a set of SURCLES may be provided in the same manner as shown in FIG. 2, but comprising a set of round SURCLES or a set of oval SURCLES.

A polygonal SURCLE 202, 204, 206 may have any number of base sides 102 ranging from 5 to a number that may be only limited by practicality of construction.

A polygonal SURCLE with large number of base sides 102, for example 60, may practically behave in the same manner as a SURCLE with a circular diameter (see round SURCLE 206 in FIG. 2) and therefore it may be more practical from an economical point of view or from a constructional point of view to manufacture a SURCLE having a circular diameter. The length of the base side 102 may be from approximately 1 cm to approximately 30 cm and may be, for example, 8 cm. The width of the SURCLE, i.e. the distance between the rails 110 (FIG. 1) at the open ends of the cylinder which defines it, may be approximately 20 cm to approximately 2 m, for example, 46 cm. In general, a wider SURCLE may be suitable for adults, whereas a narrower SURCLE may be more suitable for children. The diameter 210 (FIG. 3) of the SURCLE may lie in the range from approximately 30 cm to approximately 2 m and be, for example 85 cm. As already mentioned, the base sides 102 do not have to be of equal length. For example, a shorter base side 102 length and a longer base side length 102 may be arranged in an alternating manner to form the polygonal shape of a SURCLE thereby adjusting its balancing dynamics during use.

The geometry and the dimensions of the rectangles forming the outer surface of a polygonal SURCLE may be seen as parameters defining its (desired) instability and thereby the difficulty level of the exercise performed thereon. The diameter of a polygonal SURCLE may be adjusted by adjusting the number of base sides 102, i.e. by adjusting the number of sides created during manufacturing (e.g. by extrusion) of the SURCLE, and/or by adjusting the length of its base sides 102. With a growing length of the base side 102 the stability of a polygonal SURCLE will increase. With a growing number of base sides 102 and a simultaneous decrease of their shorter side length the SURCLE will become less stable and approach a round SURCLE. The round cylinder (see SURCLE 206 in FIG. 2) represents the limit case of an infinitesimally short base side 102 length combined with an infinite number of base sides 102. It is the least stable form of the SURCLE and may be suitable for exercises performed by advanced users. In general, a set of SURCLES used for physical exercises may include SURCLES of various shapes (i.e. polygonal, round or oval) and various diameters.

Figure 3:
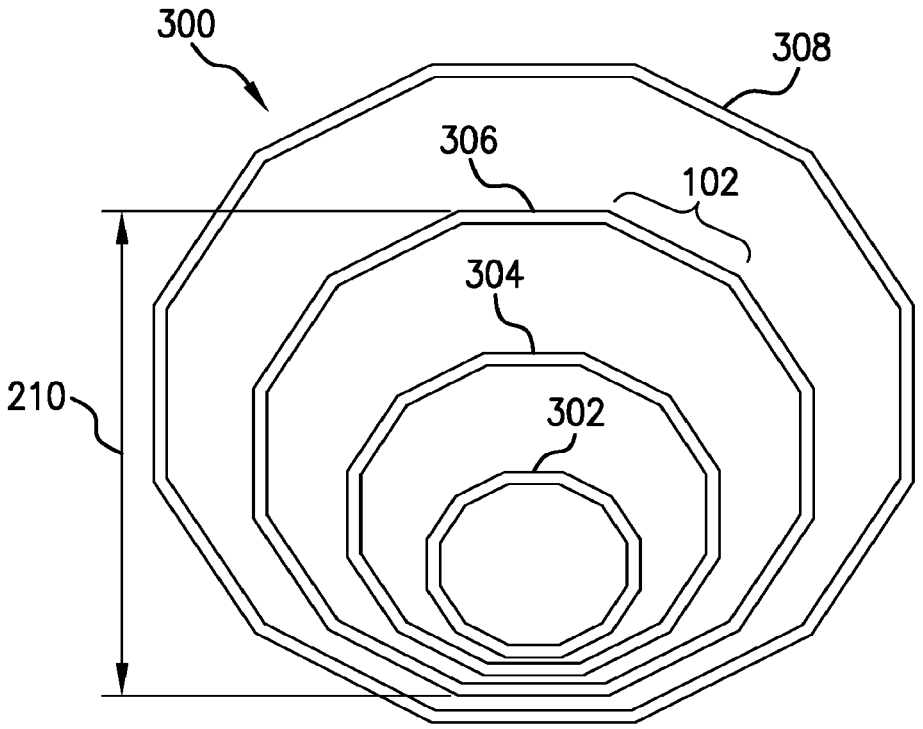
FIG. 3 shows a schematic overview of a further exemplary set of apparatuses for physical exercises.

In FIG. 3 a schematic side view of a further illustrative set of polygonal SURCLES 300 is shown. All polygonal SURCLES in the set 300 have dodecagonal (twelve-sided) shapes of their bottom and top, i.e. each having twelve base sides 102. That is, the first SURCLE 302 being the smallest one within the set has a shorter base side 102 length than the second SURCLE 304, which in turn has a shorter base side 102 length than the third SURCLE 306, which in turn has a shorter base side 102 length than the fourth SURCLE 306. The number of SURCLES and their form in the set 300 shown in FIG. 3 is arbitrarily chosen and should not be perceived as limiting in any sense. As shown in FIG. 2, FIG. 3 and FIG. 9, the set of SURCLES may be aligned in a nested manner by placing the SURCLES into one another according to their size. As shown in FIG. 9, a fully nested set of SURCLES provides a platform for execution yoga movements such as the Lotus Position. According to the invention, the combined weight of nested SURCLES creates greater stability beneath the user. Inversely, the difficulty level of a Lotus Position increases as more SURCLES are removed from the nest (FIG. 9B). Once again, even though not explicitly shown, a nested set of SURCLES may be also formed on the basis of round and oval SURCLES.

Figure 4A:
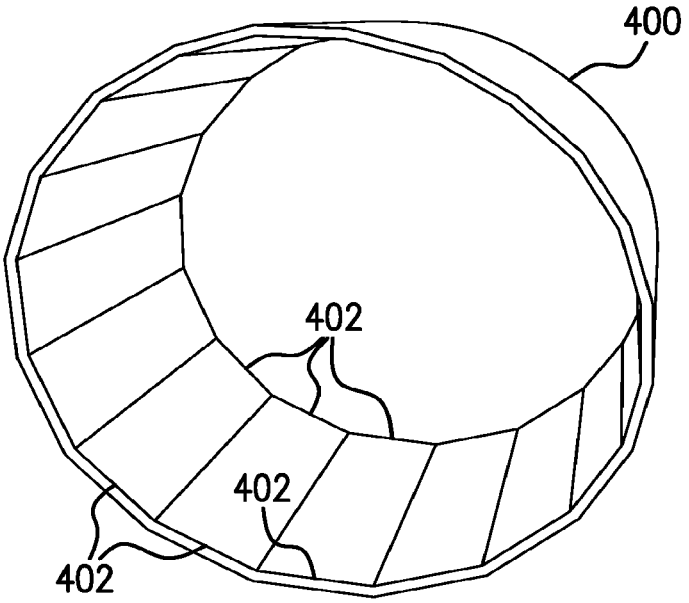
FIGS. 4A-B show illustrative embodiments of an apparatus for physical exercises.

FIG. 4A shows an illustrative embodiment of a polygonal SURCLE 400 as may be readily manufactured. The SURCLE 400 is a cylinder of polygonal shape formed of an extruded aluminum tube. Alternatively, the SURCLE 400 may be formed by rolling sheets of aluminum, stainless steel, carbon fiber, PVC etc. into polygonal cylinders. In this exemplary embodiment, the number of sides 402 amounts to 20. The thickness of the sides 402 is 5 mm, which proves stability along the z-axis. In further exemplary embodiments, only segments or parts of a polygonal SURCLE may be composed of flexible panels 402 whereas the rest of the side surface may be composed of less flexible or rigid, non-flexible panels. The SURCLE 400 is clad with a soft neoprene sport cover, which may be chosen such that they provide more comfort for the user during take-offs, Giant Laybacks or any other exercise.

Figure 4B:
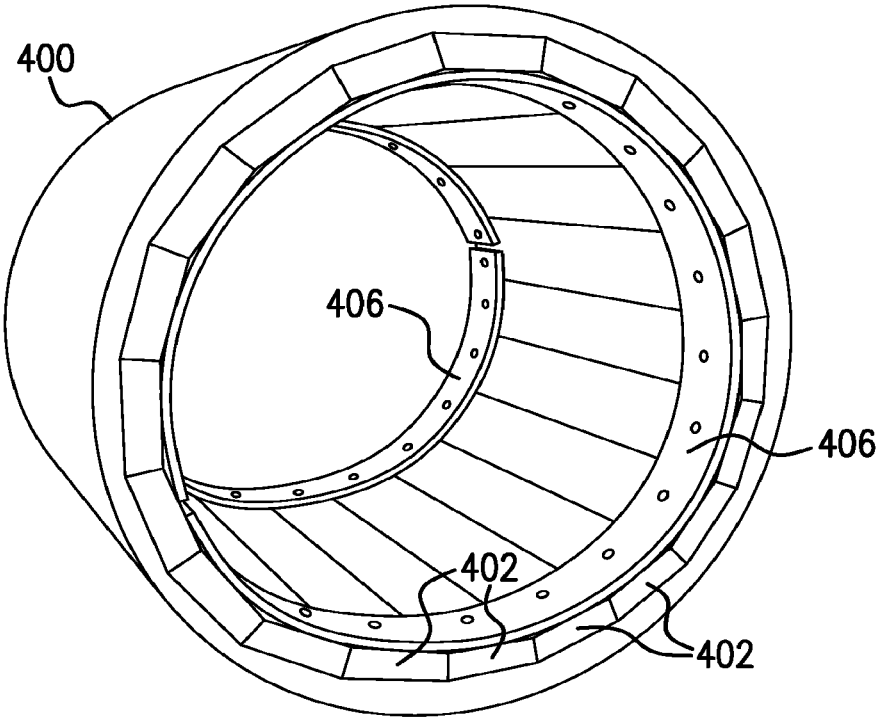

FIG. 4B shows a further embodiment of a polygonal SURCLE which may include various segments, each segment being composed of panels having a different degree of flexibility. The elements 402 may be held in place by a supporting structure. In this case, the supporting structure includes two rings 404, 406, each of them being placed concentrically within the barrel forming the SURCLE 400 in the vicinity of an opening of the barrel. The rings 404, 406 may be formed of a rigid material such as steel or iron or of a flexible material. A combination of a flexible or compressible supporting structure with flexible or non-flexible panels 402 may add a further degree of motion to the SURCLE 400. In alternative embodiments, the supporting structure may be any other structure which is able to provide stability (up to a certain degree of compressibility of the barrel when a person steps on it) and to keep the panels 402 in place. As such, the supporting structure may include a spiral arranged concentrically within the barrel forming the SURCLE 400, the spiral being in contact with the panels 402. In further embodiments, the supporting structure may include a cylinder which is placed concentrically within the barrel forming the SURCLE 400, the cylinder being at least partially in contact with the panels 402. The support structure cylinder itself may be hollow or filled with a material which may be non-compressible or compressible, the latter being the case when a further degree of motion is desired as described above. As further shown in FIGS. 4A-B, the side surface 400 of the SURCLE 400 is clad with a (cladding) material. The cladding or padding material wound around a SURCLE may be a functional material providing increased grip and a smoother surface. The material of the padding may be varied in order to adjust (i.e. increase or decrease) the stability of the SURCLE along its rolling direction. For example, reducing the surface density of the padding material may induce more wobble or put differently further destabilize the SURCLE, primarily along its rolling direction but also along its non-rolling directions, i.e. along the axis of its rotational symmetry. The analogy may be strength training with increasingly heavy dumbbells. The padding material may be accessory and a SURCLE may be provided with different sheets of padding materials which may be exchanged against one another. This may provide an easy way to adjust the instability of the SURCLE which the user may easily adapt according to the desired level of difficulty of the exercise to be performed on the SURCLE(s).

The SURCLES 400 and, in general, any SURCLE may be used on any kind of supporting floor 108 or subsurface. However, by choosing a specific subsurface 108 on which a SURCLE (or more SURCLES if more than one is used for an exercise) is placed for performing exercises, the difficulty level of a given exercise may be adjusted. For example, by performing exercises on the SURCLE on a soft and yielding subsurface such as beach sand, the SURCLE may be pressed into the ground by the weight of the user standing thereon which will stabilize the SURCLE. In contrast, when the exercises on the SURCLE are performed on a hard and unyielding subsurface such as tarmac or house floor, the SURCLE may be very unstable which may increase the level of the performed exercise.

Figure 5A:
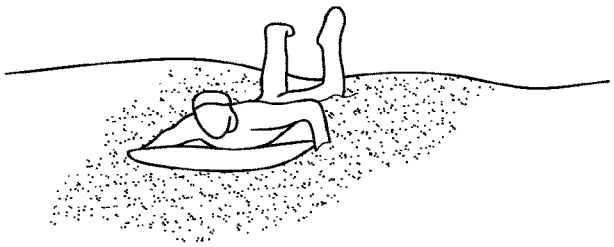
FIGS. 5A-C show the take-off movement on a surfboard.
Figure 6A:
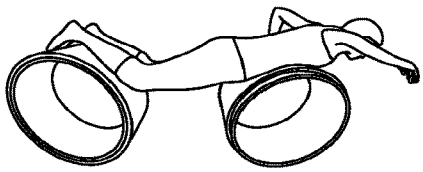
FIGS. 6A-C show training for the take-off movement in surfing using a set of devices for physical exercises according to the present invention.
Figure 5B:
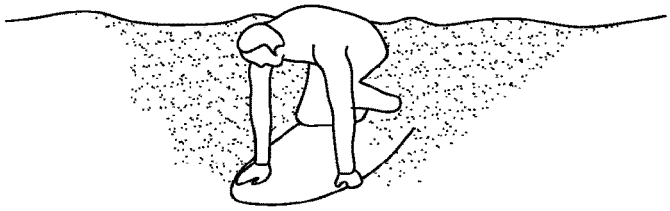
Figure 6B:
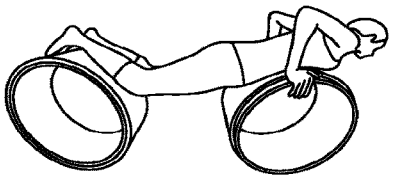
Figure 5C:
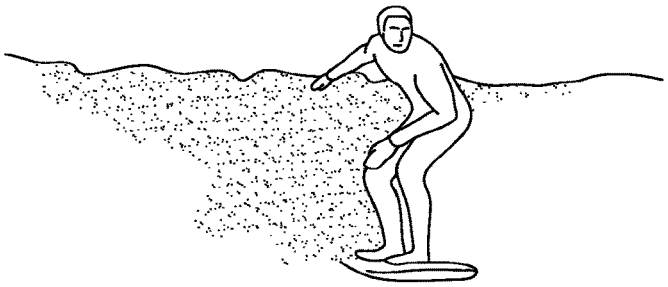
Figure 6C:
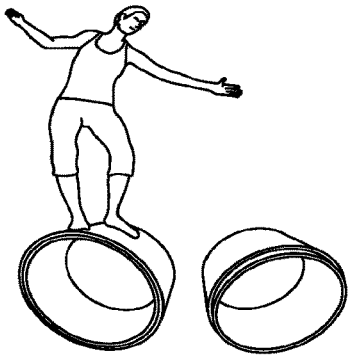

As mentioned previously, even though SURCLES may be used for various physical exercises, its prime field of application is dry land surf-specific training. FIGS. 5A-C show the take-off movement on a surfboard that may be effectively practiced using two SURCLES. As shown in FIGS. 6A-C, the surf take-off includes transitioning from a prone position on the surfboard (see FIG. 6A) to a standing position on the surfboard (see FIG. 6C). As depicted in FIGS. 6A-C, this chain of movements may be practiced using two SURCLES. As shown, the SURCLES used for that exercise are round cylinders, i.e. cylinders with round cross sections. In the starting position, the body of the surfer is suspended on or is supported by two SURCLES, one SURCLE supporting his legs and one SURCLE supporting his chest (see FIG. 6A). This position mimics a "floater," i.e. a surfer who is waiting on a surfboard for a wave to approach which he can ride. In a next step, the surfer pushes off the SURCLE underneath his chest with his arms (see FIG. 6B) and transitions to a standing position on the other SURCLE which was supporting his legs (see FIG. 6C). When using two SURCLES for surf take off training, the challenge lies in pushing off one SURCLE and coming to a standing position on the other SURCLE such that the movement of both SURCLES is controlled. The polygonal shape of the SURCLES creates a semi-stable platform characterized by an uneven movement or wobble. This wobble mimics the shifting motion of the ocean which enhances the benefits of training, with respect to balance and agility. When multiple SURCLES are used to performed any one of the exercises disclosed herein, differently sized and shaped (i.e. polygonal, round or oval) SURCLES may be mixed.

Figure 7A:
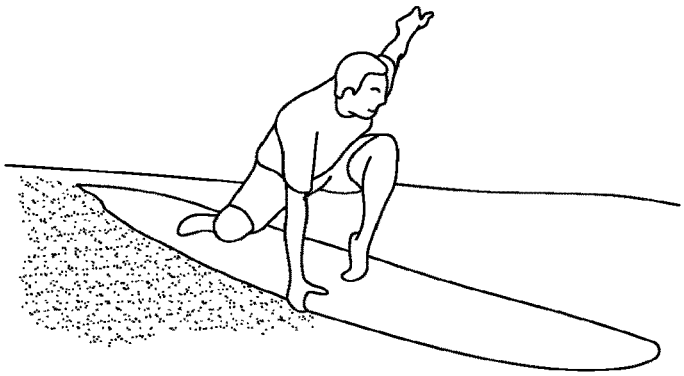
FIGS. 7A-B show typical postures on a surfboard during surfing.
Figure 8A:
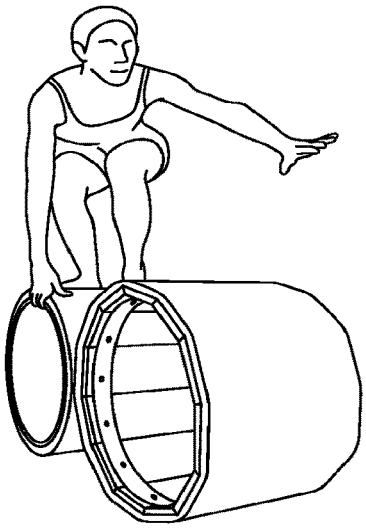
FIGS. 8A and 8B show postures practiced on an apparatus for physical exercises corresponding to those of FIGS. 7A and 7B, respectively.
Figure 8B:
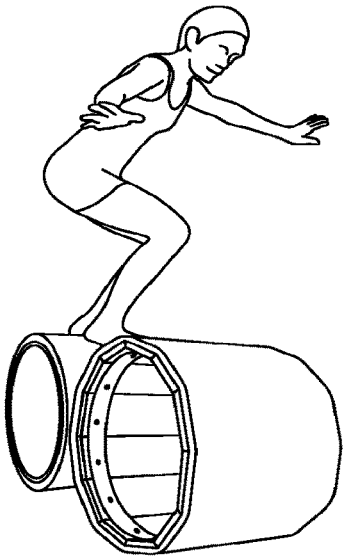

In FIG. 7A, a typical posture on a surfboard during surfing is shown. The required balance and control of the motion of the surfboard on an ocean wave can be practiced on a SURCLE, as shown in FIG. 8A in which the corresponding posture from FIG. 7A practiced on a SURCLE is shown. As shown in FIGS. 8A and 8B, two differently shaped SURCLES are used to perform that exercise, one being round and one being polygonal. This concept applies to all exercises. That is, by mixing different sizes and shapes of the SURCLES used, each exercise may be adjusted to the subject's skills and body dimensions.

Figure 7B:
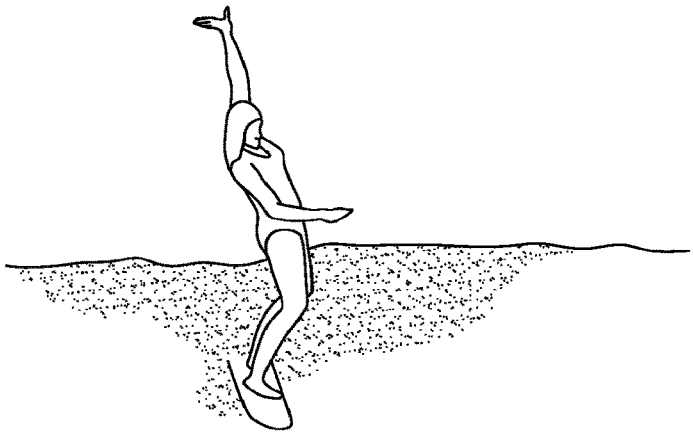

A further typical posture—standing upright on a surfboard—is shown in FIG. 7B. This posture can be practiced on a SURCLE as well as shown in FIG. 8B.

Figure 9A:
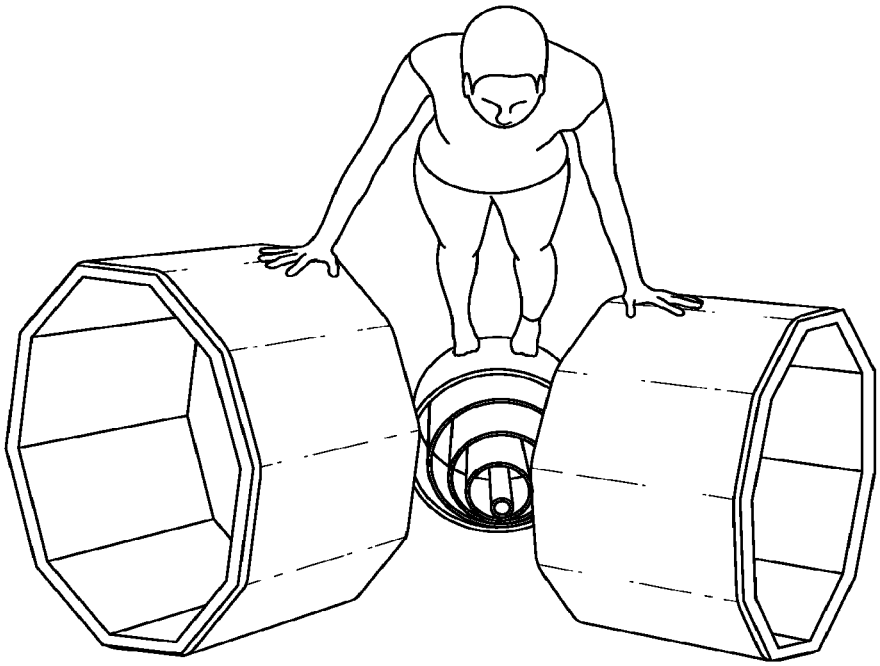
FIGS. 9A-B show an illustrative exercise to build core and upper body strength using two or more devices according to the invention.
Figure 9B:
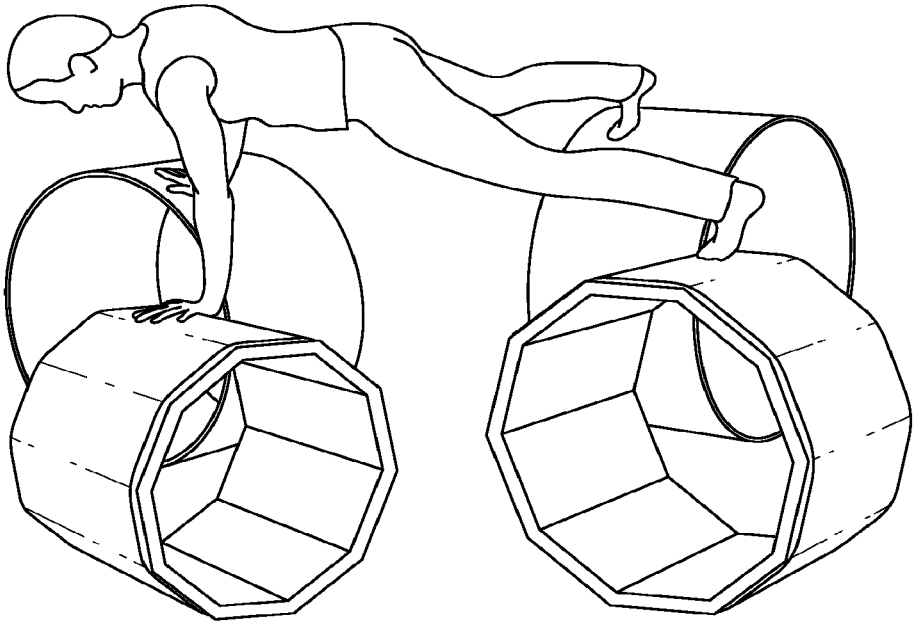

FIGS. 9A-E show illustrative exercises demonstrating the application of SURCLES as a general fitness system, which is potentially applicable to any and all training regimes. FIGS. 9A and 9B show illustrative exercises to build core strength using the apparatus for physical exercises. As shown, two or three SURCLES (also four SURCLES of the same or different size and shape may be used—one for every limb—according to a further embodiment not shown in the figures) may be used, their rolling surfaces, i.e. their side surfaces being oriented at an angle or perpendicularly to one another. The body of the trainee is supported by the two, three (or four) SURCLES; his feet resting on one (or two) SURCLES and his arms propped against one or two other SURCLES. The exercise may be to stay in balance in this position or, in addition, to perform push-ups in that position, keeping the SURCLES in place and the body in balance or to slightly move one of the SURCLES or both SURCLES to its sides. Various other exercises may be performed on two or more SURCLES. For example, as shown in FIGS. 9A-B, round and polygonal SURCLES can be mixed to achieve asymmetry with regard to the stability of the training apparatus.

Climbing often involves the independent placement of all four limbs upon polygonal shaped rocks. This maneuver may be modelled, as mentioned above with regard to the exercises shown in FIGS. 9A and 9B, using four separate SURCLES of the same or different sizes and shapes, wherein each limb is placed on one SURCLE while trying to maintain the body in a push-up like position. The body may be then lowered while trying to stay in balance or one of the limbs may be taken off the corresponding SURCLE and the body may be balanced on three limbs (e.g. two hands and one leg). The polygonal shape of the SURCLES facilitates stable placement of devices on the floor of the training, while the round shape of the SURCLES provides more instability and is thus more challenging. In addition, however, the cylindrical shape creates a semi-stable platform; forcing the user to manage the wobble of the device, thus further enhancing the training benefits.

Figure 9D:
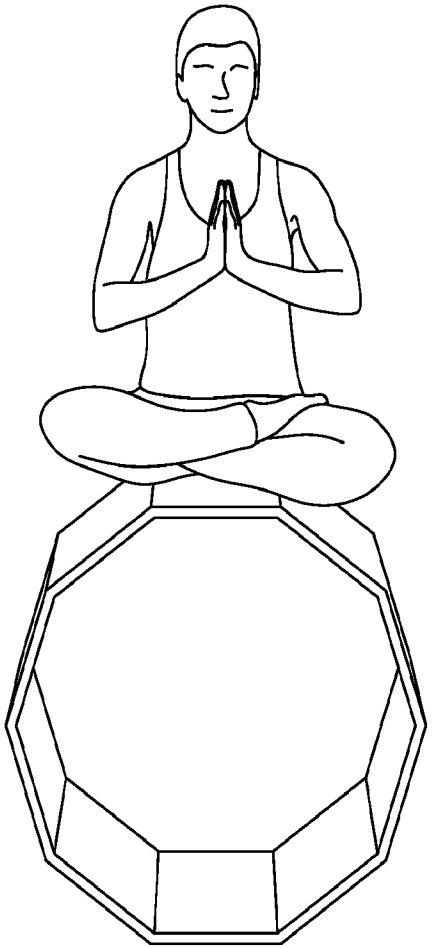
FIG. 9D shows an illustrative exercise performed on a SURCLE to develop spatio-temporal awareness, according to the invention.
Figure 9C:
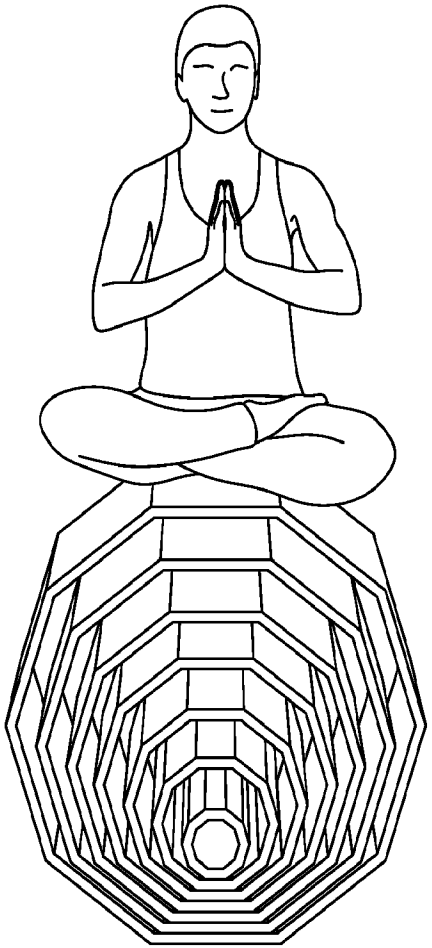
FIG. 9C shows an illustrative exercise, known as the Lotus Position, using a set of four SURCLES in a nested configuration.

FIG. 9C shows use of SURCLES for support during a yoga movement known as the Lotus Position. In this case, the difficulty of the position increases inversely to the number of SURCLES in the nest. For example, a set of nine nested SURCLES provides the most stable base for the Lotus Position, as compared to that provided by a nested set of four SURCLES shown in FIG. 9B, and to that provided by a single un-nested SURCLE. The Lotus Position (as well as any other exercise disclosed herein) may be, of course, performed accordingly on a nested configuration of polygonal, round or oval SURCLES.

FIG. 9D demonstrates the use of SURCLES to train spatio-temporal skills. In this case, the user is perched upon a SURCLE, the size (diameter) of the SURCLE determining the difficulty level of the exercise. More precisely, primarily two distinct variables challenge the trainee are at work: stability and height. Stability varies as the diameter and shape of the SURCLE changes, with a rather large polygonal SURCLE providing greatest stability and a rather small round SURCLE providing the least stability. Conversely, a rather large SURCLE positions the trainee further from the floor, providing a greater balancing challenge than either a medium sized SURCLE shown in FIG. 9D or an even smaller SURCLE than that. Once again, the SURCLE used for that exercise may be also round or oval.

Figure 9E:
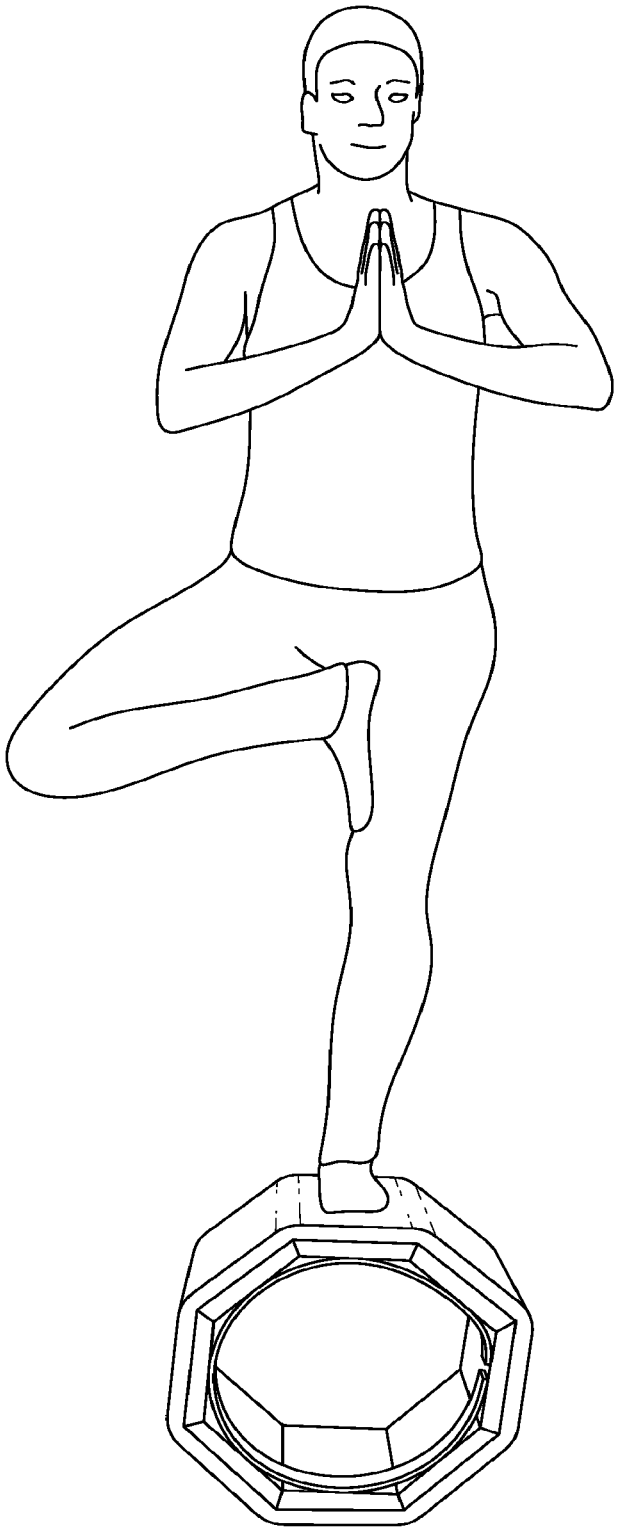
FIG. 9E shows an illustrative exercise using one polygonal (octagonal) SURCLE to train the standing Tree Pose, according to the invention.

FIG. 9E demonstrates the use of a polygonal SURCLE as a platform for a yoga posture called the Tree Pose. Use of a polygonal SURCLE in this manner provides a greater challenge than performing the same pose on the floor. Attempting to perform the same pose on a round SURCLE may be a great challenge for experienced practitioners, but nearly impossible and possibly dangerous for the average practitioner.

There are various methods for exercise using one, two or more SURCLES which exploit the characteristic features of the SURCLES as described above. In general, the SURCLE training system may be primarily used for coordinated balance training. Therefore, methods for practicing may include standing or squatting on one SURCLE and trying to stay in balance. In addition, exercises may be performed on a SURCLE that are normally performed on solid ground in the gym, such as squats or weight training with dumbbells or barbells. Also, trying to move from one SURCLE to another one may be a form of exercise. Dry land surf-specific exercises which may be performed on the SURCLE (S) and which are mimicking movement patterns required for surfing have been described with reference to FIGS. 6A-C, 7B, 8B and 9. However, many more exercises involving SURCLES may be thought of such that those explained or outlined in this specification are not to be construed as limiting the range of exercises for which the SURCLE training system has been designed in any sense. In addition to surfing, SURCLES may be also used to train climbing movements. Climbing often involves the independent placement of all four limbs upon polygonally shaped rocks. This maneuver may be modelled using four separate SURCLES of the same or different sizes, wherein each limb is placed on one SURCLE while trying to maintain the body in a push-up like position. The body may be then lowered while trying to stay in balance or one of the limbs may be taken off the corresponding SURCLE and the body may be balanced on three limbs (e.g. two ands and one leg). The polygonal shape of the SURCLES facilitates stable placement of devices on the floor of the training facility as compared to round or oval SURCLES which may be useful for more experienced users. In addition, the polygonal shape creates a semi-stable platform, forcing the user to manage the wobble of the device, thus further enhancing the training benefits.

Figure 10A:
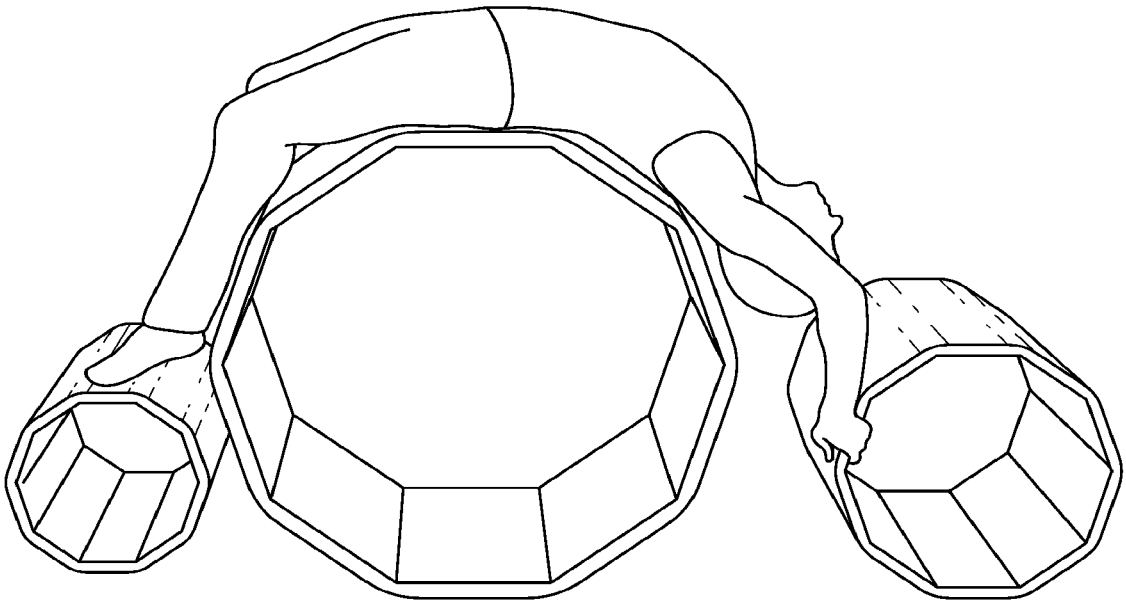
FIG. 10A shows an illustrative exercise for physical therapy, known as the "Giant Layback," using three SURCLES, according to the invention.
Figure 10B:
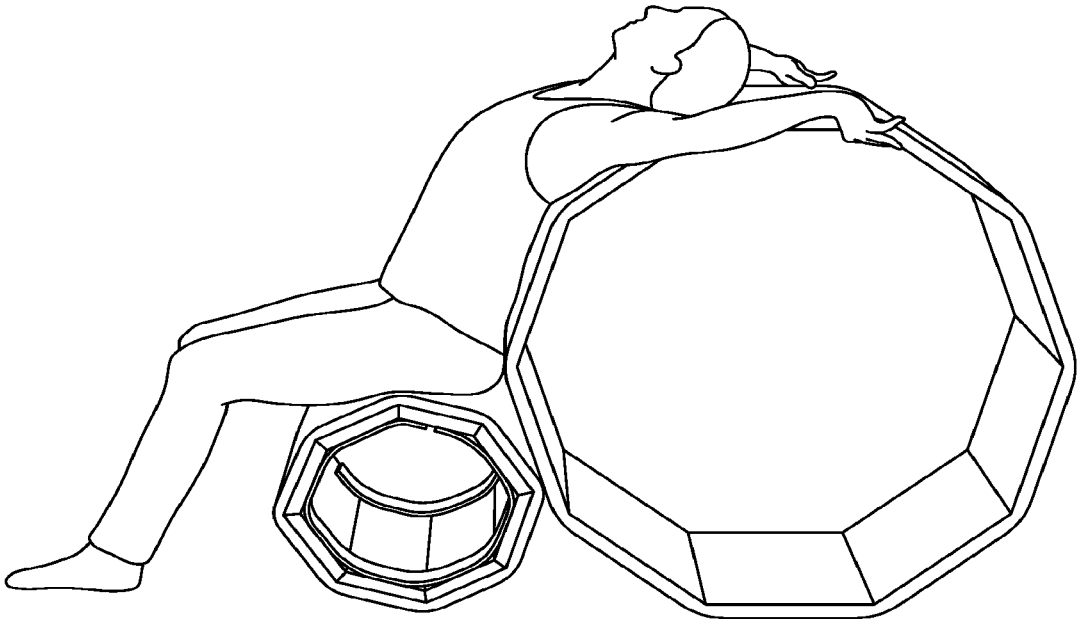
FIG. 10B shows an illustrative exercise for physical therapy using two SURCLES, according to the invention.
Figure 11A:
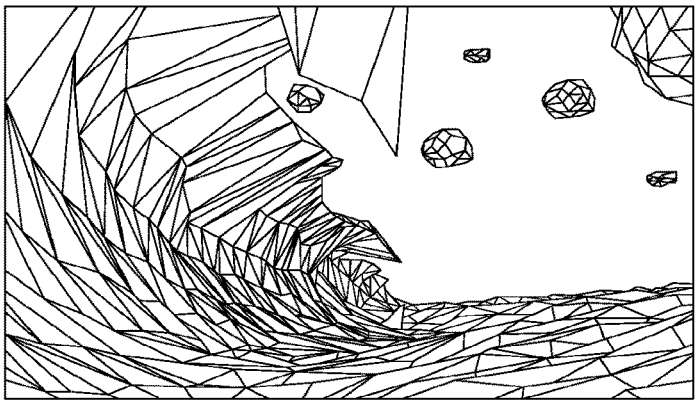
FIG. 11A shows an artistic image of waves and FIG. 11B shows an image of artificial rock elements in a climbing gym, both of which may be represented as polygonal composites in the form of differently sized polygonal SURCLES, shown in FIG. 11C.
Figure 11B:
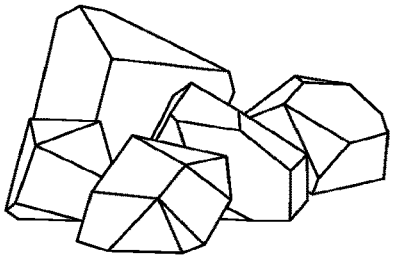
Figure 11C:
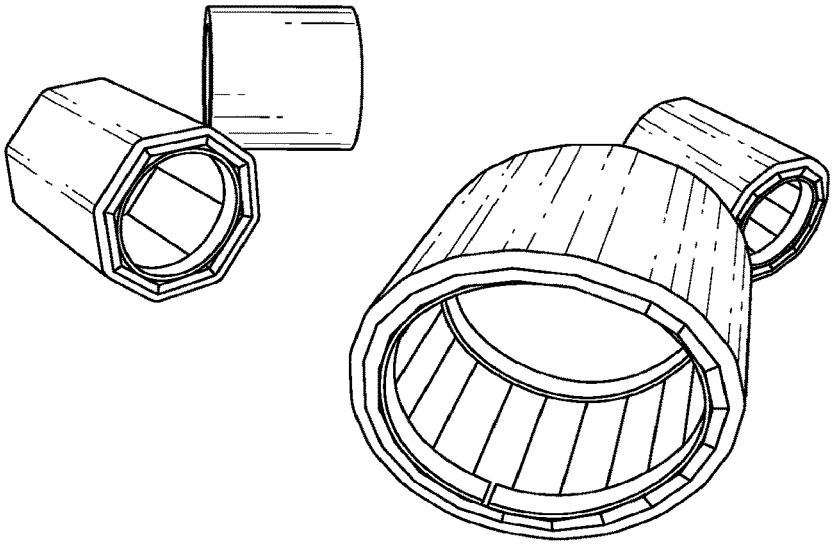

FIGS. 10A-B show that in addition to surf-specific and all-around fitness applications, SURCLES is designed as a system for physical therapy. One exercise of the SURCLE therapy system aimed at increasing flexibility of the body, to name just one of very many possible physical therapy exercises, may be to lay with ones back on a SURCLE thereby stretching the body (FIG. 10A). The SURCLE provides a laterally stable surface for stretching the back, allowing a rocking motion only along one direction, the x-axis. In this respect, a SURCLE may prove more suitable for flexibility exercises than the Swiss fitness balls, which are commonly used in gyms. Laying back on a Swiss fitness ball, which is basically a flexible rubber ball, may prove challenging for unfit patients or patients with back injuries due to the inherent 360-degree lateral instability of the Swiss fitness balls. In some cases this may cause back pain. This problem may be solved using a SURCLE as it is laterally stable and has only one axis of instability (in the direction in which the device may roll on the subsurface, along the x-axis). The controlled movement provided by SURCLES may also benefit users suffering from physical challenges including but not limited to paralysis, sexual dysfunction & dissatisfaction, nerve damage, psychologic conditions, etc.

There are various methods for exercise using one or two SURCLE which exploit the characteristic features of the SURCLE as described above. In general, the SURCLE training system may be primarily used for coordinated balance training. Therefore, methods for practicing may include standing or squatting on one SURCLE and trying to stay in balance. In addition, exercises may be performed on a SURCLE which are normally performed on solid ground in the gym, such as squats or weight training with dumbbells or barbells. Also, trying to move from one SURCLE to another one may be a form of exercise. Dry land surf-specific exercises which may be performed on the SURCLE and which are mimicking movement patterns required for surfing have been described with reference to FIGS. 6-9. However, many more exercises involving SURCLE may be thought of such that those explained or outlined in this specification are not to be construed as limiting the range of exercises for which the SURCLE training system has been designed in any sense.

FIG. 10A demonstrates a posture called the Giant Layback, which is performed using three SURCLES. The effect of performing this maneuver on SURCLES of various sizes (diameter) is to create a different angle-of-stretch along the x-axis. During the movement, an additional SURCLE is employed to provide reference and support for the hands. This additional SURCLE may be grasped on the rails (edges) with the hands in order to enhance the stretch along the x-axis. An additional SURCLE is also employed to provide reference and support for the feet. In addition to the stretch achieved along the x-axis, stable inversion of the entire torso may be achieved, facilitating changes in the direction of blood flow and other therapeutic effects. The angle of stretch may be varied by choosing a different size of the SURCLE on which the body is resting. The size of the supporting SURCLES (i.e. the ones used as support for hands and feet) may be also varied to adjust the range of the stretch. For example, when rather large SURCLE is used for supporting the hands, it may be grasped at a location higher above the floor in comparison to a smaller SURCLE which may be only grasped at a location close to the floor which may further intensify the stretch.

FIG. 10B demonstrates application of two SURCLES during Seated Layback exercises to improve posture. Alternatively, a single SURCLE may be used as a chair replacement during work at a desk and/or computer. In fact, a single SURCLE may be suitable for any seated activity, providing dynamic support with movement along the x-axis only. The dynamic support means that the user may work without fear of falling or shifting from side to side, while freely rolling the SURCLE back and forth to stimulate circulation and improve mental acuity. The exercise begins with the trainee sitting upright on the smaller SURCLE, his lower back touching the bigger SURCLE. Then, as shown in FIG. 10B, the trainee leans back towards the bigger SURCLE, her back clinging to the surface of the bigger SURCLE.

Again, even though the exercises in FIGS. 10A-B are illustrated based on polygonal SURCLES, round or oval SURCLES or a mixture of the available forms may be used for the exercises.

According to further embodiments, the apparatus may include one or more cylinders with a rectangular or square cross section. In the context of this description, a cylinder may be understood as a hollow body with two regions bound by the cylindrical surface which may be of various shapes, among others polygonal, rectangular, square, round, oval or other. Square and/or rectangular SURCLES (i.e. a cylinder with square or rectangular bases) represent the most stable device in the SURCLES Training System. They provide a baseline for entry level users to manage the spatio-temporal challenge of exercising while elevated off the ground. For example, during climb training (FIG. 9B), the act of balancing on square SURCLES with a height of 95 cm is more difficult than balancing on SURCLES of only 35 cm, because of the added distance to the ground and the inherent risk of injury by falling. Furthermore, as with SURCLES of any shape, the instability of square devices may be enhanced by decreasing the width and/or the number of SURCLES nested within, due to changes in the center of gravity.

The apparatus and methods presented herein are also advantageous with respect to mental health, in that SURCLES are grounding. The SURCLE, when used during any exercise, is able to place the exercising subject in touch with his or her body and increase self-awareness of the subject's breathing and mental state. The process of using the SURCLES requires mindfulness and deepens mindfulness practices. In treating mental illness and managing the impact of life stressors, the practice of mindfulness enables individuals to decrease symptoms as well as achieve illness remission. Wellness requires using and managing coping skills and mindfulness is a practice, which teaches individuals about their strengths. The research on the power of exercise and mindfulness to improve mental and physical health is both growing and compelling, and demonstrates the efficacy of SURCLES therapy as a treatment for depression, anxiety, and trauma.

What is claimed is:

1. An apparatus for physical exercises comprising:

a first rigid, substantially hollow cylinder comprising a polygonal cross section and extending a length from a first open end to a second open end, wherein the first cylinder is assembled from at least five rectangular sections each having two shorter sides and two longer sides, wherein the rectangular sections are arranged adjacent to one another to form an outer surface of the first cylinder, and wherein the shorter sides of the rectangular sections form the polygonal cross section; and a second cylinder removably and concentrically disposed within the first cylinder, wherein the second cylinder comprises a cross-sectional shape that is the same as the polygonal cross-sectional shape of the first cylinder, and wherein the second cylinder comprises a diameter that is smaller than a diameter of the first cylinder.

2. An apparatus according to claim 1, wherein each of the two shorter sides of each of the rectangular sections comprises a length that is equal.

3. An apparatus according to claim 1, further comprising:
a supporting structure located within the first cylinder,
wherein the rectangular sections are attached to the supporting structure.

4. An apparatus according to claim 3, wherein the supporting structure comprises at least two rings located concentrically within the first cylinder, at a distance from one another.

5. An apparatus according to claim 4, further comprising:
a cladding material provided on the outer surface of the first cylinder,
wherein the cladding material is compressible under pressure.

6. An apparatus according to claim 4, wherein a shape of the first cylinder is substantially sustained under pressure of a person performing exercises on said cylinder.

7. An apparatus according to claim 1, wherein:
the first cylinder is formed via extrusion of a material such that the first cylinder is seamless.

8. An apparatus according to claim 7, wherein the material is selected from the group consisting of: aluminum, stainless steel, carbon fiber, fiberglass, fiberglass composites and plastic.

9. An apparatus according to claim 1, wherein:
the first cylinder is formed via rolling of a material such that the first cylinder comprises one or more seams.

10. An apparatus according to claim 9, wherein the material is selected from the group consisting of: aluminum, stainless steel, wood, bamboo and carbon fiber.

11. An apparatus according to claim 1, wherein the first cylinder comprises a diameter of between 30 cm and 2 m.

12. An apparatus according to claim 1, wherein the length of the first cylinder is between 30 cm and 2 m.

13. A method comprising:
performing a physical exercise on an apparatus comprising:
a first rigid, substantially hollow cylinder comprising a polygonal cross section and extending a length from a first open end to a second open end,
wherein the first cylinder is assembled from at least five rectangular sections each having two shorter sides and two longer sides,
wherein the rectangular sections are arranged adjacent to one another to form an outer surface of the first cylinder, and
wherein the shorter sides of the rectangular sections form the polygonal cross section; and
a second cylinder removably and concentrically disposed within the first cylinder,
wherein the second cylinder comprises a cross-sectional shape that is the same as the polygonal cross-sectional shape of the first cylinder, and
wherein the second cylinder comprises a diameter that is smaller than a diameter of the first cylinder.

14. A method according to claim 13, wherein the physical exercise is selected from the group consisting of: balancing, standing, squatting, land-based surfing, systemic myofascial release, physical therapy and a core exercise.

* * * * *